US006112849A

United States Patent [19]

Garbers et al.

[11] Patent Number: 6,112,849

[45] Date of Patent: Sep. 5, 2000

[54] SOUND PROTECTION DEVICE FOR RAILROAD TRACK SYSTEM

[75] Inventors: Norbert Garbers, Dassendorf; Bernd Pahl, Hamburg; Jan Thiedeitz, Norderstedt, all of Germany

[73] Assignee: Phoenix Aktiengesellschaft, Hamburg, Germany

[21] Appl. No.: 09/341,158

[22] PCT Filed: Feb. 9, 1998

[86] PCT No.: PCT/DE98/00335

§ 371 Date: Jul. 2, 1999

§ 102(e) Date: Jul. 2, 1999

[87] PCT Pub. No.: WO98/37276

PCT Pub. Date: Aug. 27, 1998

[30] Foreign Application Priority Data

Feb. 19, 1997 [DE] Germany ..... 197 06 559

[51] Int. Cl.[7] ..... B64F 1/26

[52] U.S. Cl. ..... 181/210; 181/285; 181/286; 181/290; 181/293; 181/294; 244/114 B; 105/452

[58] Field of Search ..... 181/210, 285, 181/286, 290, 293, 294; 244/114 B; D25/43, 44; 105/452

[56] References Cited

U.S. PATENT DOCUMENTS

| | | | |
|---|---|---|---|
| 3,656,576 | 4/1972 | Gubela | 181/33 G |
| 4,069,768 | 1/1978 | Matsumoto et al. | 105/452 |
| 4,114,725 | 9/1978 | Croasdale | 181/205 |
| 4,142,468 | 3/1979 | Birnstiel | 104/124 |
| 4,158,401 | 6/1979 | Matsumoto et al. | 181/210 |
| 4,274,506 | 6/1981 | Blomberg et al. | 181/210 |
| 4,750,586 | 6/1988 | Lerner et al. | 181/295 |
| 5,671,685 | 9/1997 | Ughl | 105/452 |
| 5,744,763 | 4/1998 | Iwasa et al. | 181/286 |
| 6,016,888 | 1/2000 | Lynn | 181/218 |

FOREIGN PATENT DOCUMENTS

| | | |
|---|---|---|
| 2 731 722 | 9/1996 | France . |
| 33 22 189 | 1/1985 | Germany . |
| 42 12 172 | 11/1992 | Germany . |
| 44 34 269 | 3/1996 | Germany . |

*Primary Examiner*—Paul Ip
*Assistant Examiner*—Edgardo San Martin
*Attorney, Agent, or Firm*—Collard & Roe, P.C.

[57] ABSTRACT

A sound protection device for reducing the propagation of airborne sound comprises a track system and an elastically deformable, low sound-protecting wall made of rubber or plastic and extending in the longitudinal direction of the track. The sound-protecting wall is arranged at a distance to the track and on the side facing the track has a profile which essentially extends across the entire height of the wall. The side of the protecting wall facing away from the track has a generally even surface. The inner side is inclined at an angle a and the outer side at an angle β to the track, whereby angle β is greater than angle α. The profile of the inner side consists of a system of lips, which lips points towards the floor of the track at an angle γ. The top of the low sound-protecting wall ends in a lip inclined towards the track, which lip points upwardly at an angle δ. In addition, the low sound-protecting wall comprises at least one hollow chamber extending in the longitudinal direction of the track.

14 Claims, 1 Drawing Sheet

SOUND PROTECTION DEVICE FOR RAILROAD TRACK SYSTEM

CROSS-REFERENCES TO RELATED APPLICATIONS

This application is based on PCT application number PCT/DE98/00335, filed Feb. 9, 1998 and German application number 197 06 559.7 filed Feb. 19, 1997.

BACKGROUND OF THE INVENTION

1. Field of the Invention

The invention relates to a sound protection device for reducing the propagation of airborne sound, comprising a track system and an elastically deformable, low-sound protection wall made of rubber or plastic and extending in the longitudinal direction of the track, whereby the low-sound protection wall, which is arranged with a spacing from the track, has a profile on its side facing the track (innef side) which substantially extends across the entire height of the wall, whereas its side facing away from the track (outer side) has a generally even surface (DE-A-44 34 269).

2. The Prior Art

Higher requirements with respect to sound protection in connection with track installations make it necessary that the sound protection walls are installed closer to the tracks and thus to the light space profile, or project into the latter. In this connection, a sound protection wall is expected to satisfy two different requirements. On the one hand, the sound protection wall as a sound screen is expected to interrupt the sight connection from the site of emission to the site of introduction, and to permit the highest possible diffraction edge. On the other hand, the airborne sound impacting on the side of the site of emission is expected to be absorbed as effectively as possible, or to be reflected in such a way that the airborne sound is absorbed in some other way.

SUMMARY OF THE INVENTION

Now, against the background of the requirements specified above, the aim of the invention is to provide a low-sound protection wall that is designed in such a way that no vehicle material is damaged in the event of any collision. Furthermore, the function of the low-sound protection wall is expected not to be substantially reduced even in the event minor damage is caused.

Now, the low-sound protection wall as defined by the invention is characterized in that

- its inner side is inclined to the track at an angle $\alpha$ and its outer side at an angle $\beta$, in each case based on the vertical of the track, whereby angle $\beta$ is greater than angle $\alpha$;
- the profile of the inner side is a system of lips, whereby the lips point towards the floor of the track at an angle $\gamma$, namely based on the horizontal of the track;
- the top of the low-sound protection wall, where the inner side and the outer side run up to each other, is terminated by a lip inclined toward the track, said lip pointing upwardly at an angle $\delta$ based on the vertical of the track; and that
- the low-spund protection wall has at least one hollow chamber extending in the longitudinal direction of the track.

The following angle ranges usefully apply with respect to angles $\alpha$, $\beta$, $\gamma$, and $\delta$:

$\alpha$=5 to 10°

$\beta$=10 to 20°

$\gamma$=40 to 60°

$\delta$=30 to 45°.

The advantageous materials or material parameters are specified as follows:

| | |
|---|---|
| Material | EPDM, SBR, BR, or their mixtures |
| Shore hardness "A" | 55–80° |
| Tearing strength | ≧11 N/mm$^2$ |
| Elongation limit | ≧300% |
| Rebound elasticity (at RT) | ≧25% |
| Residual pressure deformation (72 h/RT) | ≦35% |
| Abrasion | ≦450 mm$^3$. |

Furthermore, the material of the low-sound protection wall should have a high loss factor (d=0.08 to 0.4) as compared to concrete and steel.

BRIEF DESCRIPTION OF THE DRAWINGS

Now, the invention is explained in the following with the help of an exemplified embodiment and by reference to a schematic drawing, whereby the following list of reference numerals and symbols applies in connection with said drawing:

1=track

2=rail

3=rail mounting

4=floor of track

5=low-sound protection wall

Figure 1:
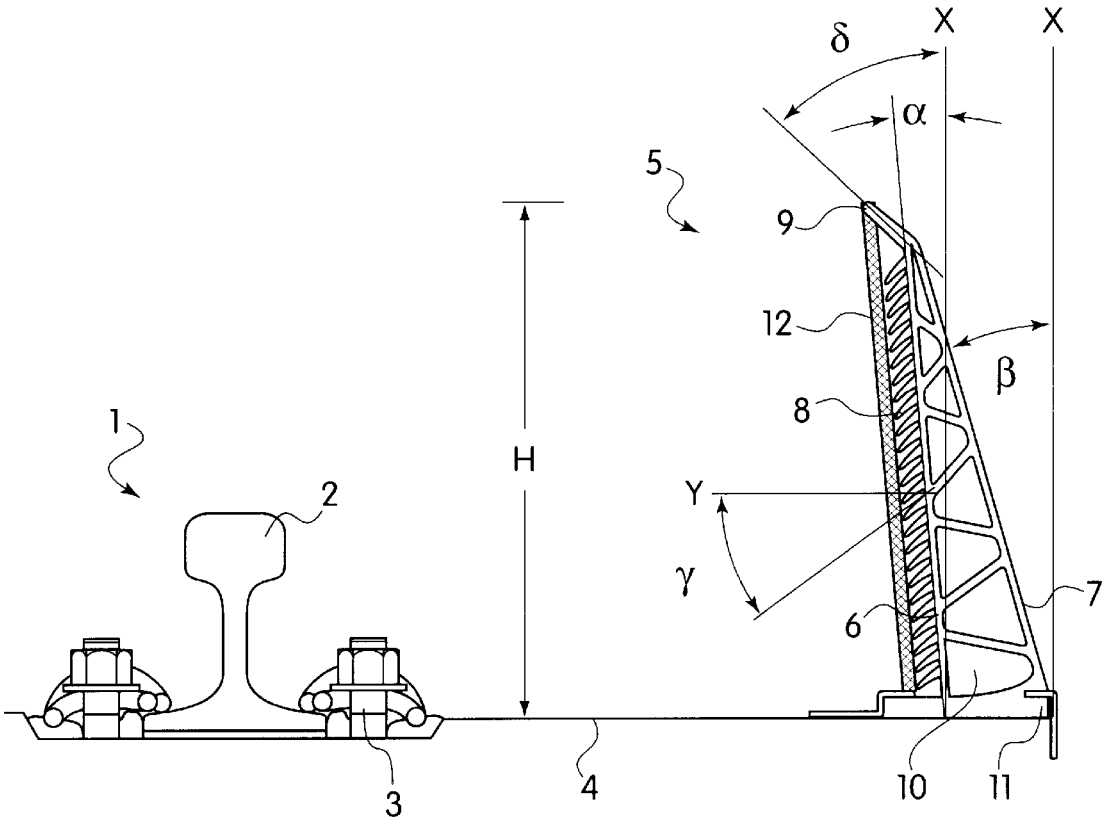

6=inner side of low-sound protection wall with inclination angle $\alpha$

7=outer side of low-sound protection wall with inclination angle $\beta$

8=lips with inclination angle $\gamma$

9=lip (terminating lip) arranged at the top with inclination angle $\delta$

10=hollow chambers

11=stationary mounting of low-spund protection wall

12=damping mat

X=vertical of track as reference point for angles of $\alpha$, $\beta$, and $\delta$ Y=horizontal of track as reference point for angle $\gamma$ H=height of sound protection wall

DETAILED DESCRIPTION OF PREFERRED EMBODIMENTS

The inner side 6 of the low-sound protection wall 5 has an inclination angle $\alpha$ in particular of 5° to 10° based on vertical X of the track. Furthermore, said inner side is terminated at the top by a lip 9 which is inclined to track 1, and which points upwardly, whereby the inclination angle $\delta$ particularly amounts to 30° to 45° also based on vertical X of the track. Due to the angle constellations according to $\alpha$ and $\delta$, the airborne sound emitted by the wheel and the track is optimally reflected to track floor 4.

Furthermore, the inner side 6 of low-sound protection wall 5 is provided with a plurality of lips 8 pointing at track floor 4, whereby the inclination angle $\gamma$ particularly amounts to 40° to 60° based on the horizontal Y of the track. Primarily the airborne sound with higher frequencies is absorbed with said lip system in that the airborne sound is reflected a number of times in the region of lips 8. Said lips advantageously have a minimum length of 5 mm in the direction of expanse, in particular a length of from 10 to 20 mm.

The upwardly pointing lip 9 terminating the low-sound protection wall 5 is longer than the lips 8 pointing in the direction of floor 4 of the track.

Height H of low-sound protection wall 5 usefully amounts to 300 to 700 mm.

The hollow chambers 10 contained in low-sound protection wall 5 and extending in the longitudinal direction of the track act as hollow-space resonators in order to primarily absorb low-frequency airborne sound. For the purpose of obtaining the greatest possible absorption width, the hollow chambers advantageously have volumes of varying sizes.

Mounting 11 of low-sound protection wall 5 is located at about the level of rail mounting 3, preferably in the region of the edge of the crosstie.

According to a design variation, the lips 8 are covered on the inner side 6 of the low-sound protection wall 5 by a damping mat 12, whereby such damping mat preferably consists of a foamed or fibrous material, which leads to further reduction of the propagation of airborne sound.

What is claimed is:

1. A sound protection device for reducing the propagation of airborne sound, comprising (a) a track system and (b) an elastically deformable low-sound protection wall made of rubber or plastic and extending in the longitudinal direction of the track, said low-sound protection wall being spaced a distance from the track and having an inner side facing the track and an outer side facing away from the track, said inner side having a profile substantially extending across the entire height of the wall, and said outer side having a generally even surface, wherein:

said inner side is inclined at an angle $\alpha$ and said outer side is inclined at an angle $\beta$ to the vertical of the track, said angle $\beta$ being greater than angle $\alpha$;

the profile on the inner side comprises a system of lips, said lips pointing towards the floor of the track at an angle $\gamma$ to the horizontal of the track;

the top of the low-sound protection wall ends in a lip inclined toward the track, said lip pointing upwardly at an angle $\delta$ to the vertical of the track; and the low-sound protection wall has at least one hollow chamber extending in the longitudinal direction of the track.

2. The sound protection device according to claim 1, wherein the inner side of the low-sound protection wall has an angle $\alpha$ in the range of 5° to 10°.

3. The sound protection device according to claim 1, wherein the outer side of the low-sound protection wall has an angle $\beta$ in the range of 10° to 20°.

4. The sound protection device according to claim 1, wherein the lips pointing towards the floor of the track have an angle $\gamma$ in the range of 40° to 60°.

5. The sound protection device according to claim 1, wherein the upwardly pointing lip terminating the low-sound protection wall has an angle $\delta$ in the range of 30° to 45°.

6. The sound protection device according to claim 1, wherein the lips pointing towards the floor of the track have a minimum length in the range of 10 to 20 mm.

7. The sound protection device according to claim 1, wherein the upwardly pointing lip terminating the low-sound protection wall is longer than the lips pointing towards the floor of the track.

8. The sound protection device according to claim 1, wherein the low-sound protection wall has a wall height of 300 to 700 mm.

9. The sound protection device according to claim 1, wherein the low-sound protection wall has a plurality of hollow chambers of varying volumes extending in the longitudinal direction of the track.

10. The sound protection device according to claim 1, wherein the low-sound protection wall consists of ethylene-propylene-diene copolymer (EPDM), styrene-butadiene rubber (SBR), butadiene rubber (BR), or mixtures thereof.

11. The sound protection device according to claim 1, wherein the low-sound protection wall has the following material parameters:

| | |
|---|---|
| Shore hardness "A" | 55 to 80° |
| Tearing strength | ≧11 N/mm$^2$ |
| Elongation at break | ≧300% |
| Rebound elasticity (at RT) | ≧25% |
| Residual pressure deformation (72 h/RT) | ≦35% |
| Abrasion | ≦450 mm$^3$ |

12. The sound protection device according to claim 1, wherein the low-sound protection wall is made from a material having a high loss factor as compared to concrete and steel.

13. The sound protection device according to claim 1, wherein the lips pointing towards the floor of the track are covered on the inner side of the low-sound protection wall by a damping mat comprising a foamed or fibrous material.

14. The sound protection device according to claim 1, wherein the track has a rail mounting and a crosstie and the low-sound protection wall is mounted at about the level of the rail mounting in the region of the edge of the crosstie.

* * * * *